United States Patent [19]

Craig et al.

[11] 4,433,967

[45] Feb. 28, 1984

[54] PUMP IMPELLER

[76] Inventors: Lawrence B. Craig, 116 Duck Pond Rd., Glen Cove, N.Y. 11542; Alfred J. Farina, 1939 Anita Ct., Baldwin, N.Y. 11510

[21] Appl. No.: 378,636

[22] Filed: May 17, 1982

[51] Int. Cl.[3] ..... F01C 5/04; F04C 27/00

[52] U.S. Cl. ..... 418/140; 418/153; 418/241

[58] Field of Search ..... 418/137, 138, 152, 153, 418/154, 178, 241, 140

[56] References Cited

U.S. PATENT DOCUMENTS 2,233,269 2/1941 Napolitano ..... 418/241
3,086,476 4/1963 Weiss ..... 418/144
3,401,872 9/1968 Adsit ..... 418/152
3,552,895 5/1969 Bayley ..... 418/152

*Primary Examiner*—Leonard E. Smith
*Assistant Examiner*—Jane E. Obee
*Attorney, Agent, or Firm*—Bauer & Amer

[57] ABSTRACT

A centrifugal pump impeller with vanes extending radially from an elastomeric hub in the operation of which the unavoidable flexing, i.e. alternately changing angular orientation, of the vanes in the hub does not contribute to any rupture, because the hub is provided with a compartment cooperating with each vane so that the flexing movements occur in that compartment, rather than causing stretching and compression in the hub elastomeric construction material which ultimately produces rupture or other such breakdown.

3 Claims, 7 Drawing Figures

PUMP IMPELLER

The present invention relates generally to improvements for a centrifugal pump impeller, and more particularly to an improved manner of combining the vanes and elastomeric hub so as to obviate rupture in the latter during pumping service of the impeller.

As is well understood and exemplified by U.S. Pat. No. 3,086,476, the construction of an impeller for a centrifugal pump is advantageously accomplished by the molding in situ of the vanes in circumferentially spaced radial relation in a moldable, elastomeric hub. Unavoidably however, the impeller is subjected to forces during normal use which contribute to rupture in the hub.

An important aspect of the present invention is the recognition that flexing in the hub-engaged vanes correspondingly causes stretching and compression of the elastomeric construction material of the hub, and that this is what ultimately causes the rupture or other breakdown in this material.

Broadly, it is an object of the present invention to thereby provide an improved centrifugal pump impeller overcoming the foregoing and other shortcomings of the prior art. Specifically, it is an object to provide an optimum minimum running clearance for the impeller in its operating or pumping chamber and, in the impeller construction per se, to eliminate the cause of rupture or breakdown in the hub elastomeric construction material.

An impeller for a centrifugal pump demonstrating objects and advantages of the present invention is of the type having an operative position rotatably mounted in a pumping chamber in said pump and consists of an elastomeric hub and plural vanes circumferentially spaced to extend in radial relation from said hub. In the construction of this type impeller, each vane is of selected geometric shape, such as a rectangular shape and is operatively disposed with a first long or outer edge thereof moving through a rotative path about the periphery of the pumping chamber, while the opposite second long or inner edge thereof is molded in situ in the elastomeric hub, with the result that the area of each vane that extends between the first and second long edges is the operative area which exerts pressure against the fluid being pumped during pumping service of the pump. Also, since the axis of the rotor is eccentric to the axis of the impeller, the angle between successive vanes changes constantly as they rotate. This continual flexing of the elastomer generates heat, material fatigue, and ultimate rupture, particularly in the vicinity of the inner edges of the vanes. In recognition of this, it is therefore provided that for each vane there be provided a compartment formed in the hub, by the absence of elastomeric material, in an area coincident with and extending along the length of the second or inner edge so as to permit unimpeded movement of said second edge in said compartment. As a consequence, the resulting movement in the vane second edge by being unimpeded, is thus a phenomenon which occurs with minimum stretching and compression of the surrounding elastomeric material of the hub, and this correspondingly contributes to obviating any rupture in the hub.

The above brief description, as well as further objects, features and advantages of the present invention, will be more fully appreciated by reference to the following detailed description of a presently preferred, but nevertheless illustrative embodiment in accordance with the present invention, when taken in conjunction with the accompanying drawings, wherein:

FIG. 2 is a partial perspective view illustrating the improved manner in which the vanes of the impeller are molded in situ in the said elastomeric hub;

FIG. 3 is a partial front elevational view, on an enlarged scale and as seen in the direction of the arrows 3—3 of FIG. 2, illustrating further details of the manner in which each vane is held in its pumping position in the elastomeric hub;

FIG. 4 is a side elevational view in longitudinal section taken along line 4—4 of FIG. 3 showing details of the compartment which is formed along the lower edge of each vane which has been found effective to relieve stress and thus obviate rupture in the elastomeric material of the hub;

FIG. 5 is a perspective view of the impeller, shown only partially, and of the rotor, intended to illustrate the manner in which the two are operatively associated incident to providing pumping service for the pump;

FIG. 6 is a front elevational view, in section taken along line 6—6 of FIG. 7, illustrating details of the assembled pump; and FIG. 7 is a side elevational view in section taken along line 7—7 of FIG. 6 illustrating further additional internal structural features of the pump.

Figure 1:
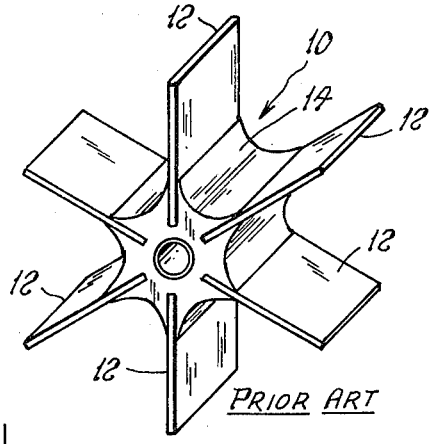
FIG. 1 is a perspective view of a typical prior art centrifugal pump impeller which is vulnerable to rupture in the elastomeric hub thereof.
Figure 5:
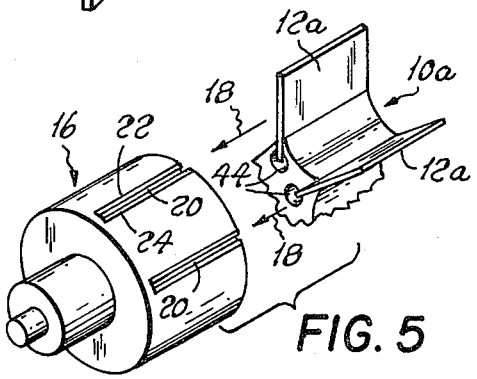
FIGS. 5, 6 and 7 illustrate the pumping environment of the improved impeller of FIGS. 2–4. More particularly.
Figure 6:
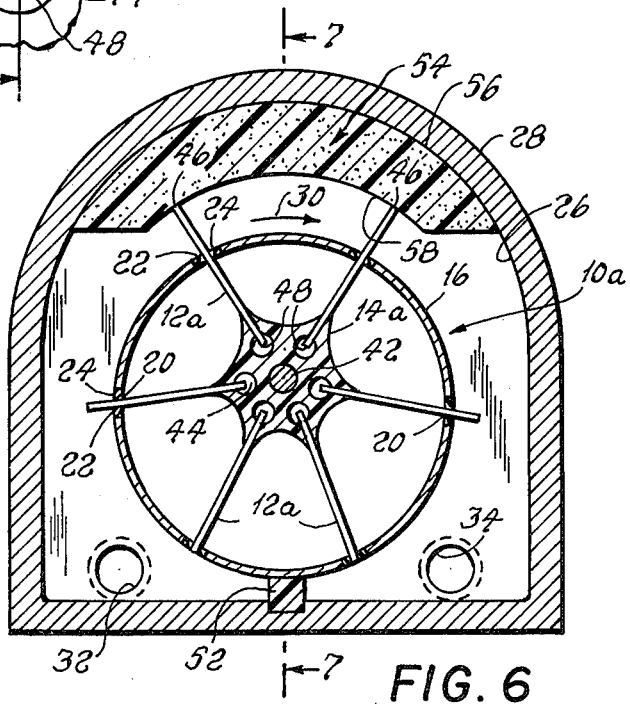

The within improvements are applied to a well known type of impeller, such as that designated 10 in FIG. 1 which is used in a centrifugal pump of the type which is described and illustrated in U.S. Pat. No. 3,086,476. As understood, impeller 10 consists of plural vanes, individually and collectively designated 12, which are molded in situ in an elastomeric hub so as to assume the spaced circumferential arrangement illustrated in FIG. 1. The prior art impeller 10 is operatively associated with a rotor which drives it in rotation during the pumping service of the pump. More particularly, and as may perhaps be best understood from FIG. 5, the impeller, whether it be the prior art impeller 10 or the improved impeller 10*a*, is assembled to a rotor 16 by having each of the vanes 12 inserted, as in the direction 18 into circumferentially spaced slots 20 in the rotor 16. More particularly, in each slot 20 there is a cooperating pair of seals 22, 24 and each cooperating vane 12 is inserted between these seals. Next, and again as may best be appreciated from FIG. 6, the assembled rotor and impeller, whether it be the prior art impeller 10 or the improved impeller 10*a*, is rotatably mounted in a pumping chamber 26 which is formed, in a well understood manner, within an external pump housing 28. In the well understood operative arrangement as just generally described, and still referring to FIG. 6, as the rotor 16 is driven in rotation in the pumping direction 30 by a motor or other prime mover (not shown), this causes the impeller 10*a* which is mounted in eccentric relation within the rotor 16 to be also driven in the direction 30. Movement of the vanes 12 in the direction 30 is, of course, against the low pressure fluid, either gas, liquid, or combinations thereof, which enters the pumping chamber 26 through the inlet 32 causing said fluid, in a well understood manner, to undergo a significant increase in its pressure in which condition it is expelled from the pumping chamber 26 through the outlet 34.

A significant aspect of the within invention is the recognition that the prior art operational mode of a driven impeller and a driving rotor, as just described, will invariably result in a significant angular and lateral movement of the vanes within the elastomeric material of the hub which is in engagement with its lower edge. This is due to the forces exerted by the drive of the rotor 16 against each vane 12*a* along the line of contact established in each sealed slot 20, and by the pressure exerted against each vane by the fluid being pumped as each vane moves through its power stroke 30, as well as possibly by other causes. In any event, part of the within invention is the recognition that the movement of the vanes within the elastomeric hub is what ultimately results in the rupture or breakdown of the elastomeric material of the hub. The improvements which are applied to the prior art pump impeller 10, now to be described in detail with specific reference to FIGS. 2, 3, and 4, have been found to be effective in obviating the rupturing of the elastomeric hub, as well as providing other benefits.

Figure 2:
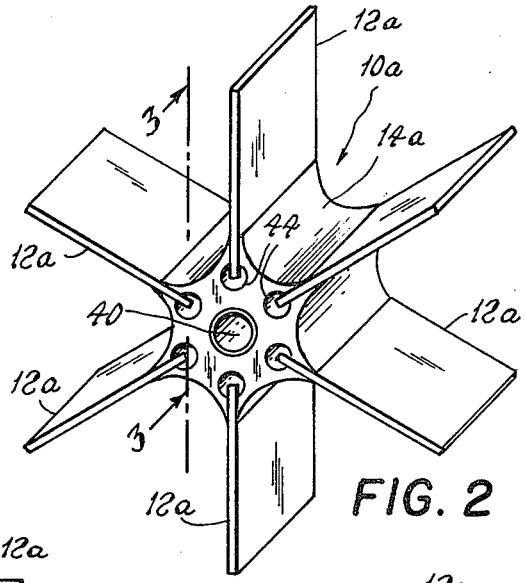
FIGS. 2, 3 and 4 illustrate improvements for the centrifugal pump impeller of FIG. 1 which obviate the rupturing or other breakdown in the elastomeric construction material of the hub thereof. More particularly.
Figure 3:
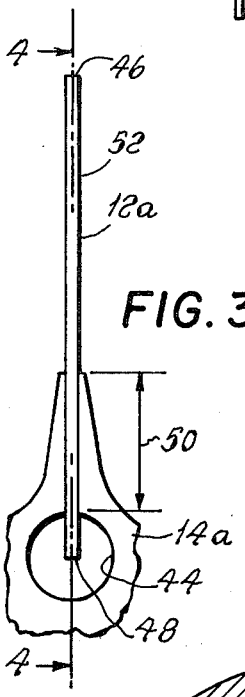
Figure 4:
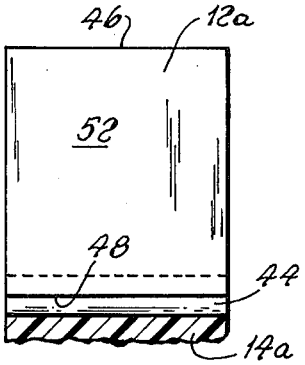

Referring now specifically to FIGS. 2–4, it will be understood that the within improved impeller designated 10*a* is, except for the important structural differences to be noted, constructed essentially as the prior art impeller 10 of FIG. 1. That is, impeller 10*a* also includes circumferentially spaced vanes 12*a*, at approximately 60 degree intervals, which vanes are molded in situ in an elastomeric hub 14*a*. Centrally located in the hub 14*a* is a mounting device which bounds a through bore 40 in which is received a shaft 42 (see FIG. 7), which supports the impeller 10*a* while it is being driven in rotation by the rotor 16.

The significant feature added to the impeller 10*a* which obviates the rupturing in the elastomeric hub 14*a* is the providing of a compartment, individually and collectively designated 44, in the area adjacent and along the lower edge of each vane 12*a* and extending the length thereof.

More particularly, and as may best be appreciated from FIGS. 3 and 4, in a preferred embodiment each vane 12*a* is of a rectangular shape, as shown in FIG. 4 and, in its operative position, has a first upper long edge 46. Said edge, and the area adjacent thereto, is the portion of the vane which is driven through the pumping stroke 30 by the rotor 16. The bottom or second long edge 48 of each vane 12*a* is the edge which is disposed in the elastomeric hub 14*a*. Unlike the pump construction in the prior art impeller 10, however, edge 48 of impeller 12*a* is not actually engaged by the elastomeric construction material but, as clearly illustrated in FIG. 3, projects in radial relation into the cooperating compartment 44 which is formed by the absence of any elastomeric material in the area adjacent and along the second long edge 48. Instead, each vane 12*a* in the improved impeller 10*a* is engaged by the elastomeric material along the area immediately above the edge 48, such as the area designated 50 in FIG. 3. The presence of the compartment 44 has been found effective in obviating any rupture in the elastomeric hub 14*a*. This is believed due to the improved operational mode which is provided by the compartment 44 as will now be explained in connection with FIGS. 3, 4.

During pumping service of the impeller 10*a*, the vane area 52 which actually contacts the fluid being pumped, namely the vane area which extends out of the elastomeric hub 14*a*, is often caused to be moved to one side or the other of its position as illustrated in FIG. 3. This flexing of each vane 12*a* in its elastomeric hub 14*a* is particularly pronounced in the area of its lower long edge 48. In the prior art embodiment, such movement in the lower edge 48, because it was attached to elastomeric material, invariably caused stretching and compression, as the case may be, in said elastomeric material. Such repeated stretching and compression ultimately resulted in overheating, and built-up stresses which caused rupture and a breakdown in the elastomeric material. In contrast, the movement of the lower edge 48 of each vane 12*a* is unimpeded in accordance with the present invention since it occurs in the compartment 44. As a result, movement in the edge 48 does not result in any stretching or compression in the elastomeric material and thus, of course, does not contribute to any rupture or breakdown in said material. Nevertheless, each vane 12*a* is effectively held in place in the hub 14*a* by the engagement between the elastomeric material with each vane which occurs along the area 50.

In addition to an improved impeller construction as just described, the within invention also provides an improved seal between the inlet and outlet portions of the pumping chamber 26. As may be best appreciated from FIGS. 6, 7, the inlet 32 and the outlet 34 are sealed from each other by top and bottom seals, the latter being a conventional seal 52. The upper seal, however, consists of a member 54 comprised of a foam plastic material, such as polystyrene of the type which is commercially available from Strux Plastics, Inc. of Farmingdale, N.Y. Member 54 is appropriately mounted in the upper portion of the pumping chamber 26 in any appropriate manner, as by being adhesively secured along its upper arcuate surface to the correspondingly arcuate portion of the pump housing 28, as at the coextensive surfaces 56. The size of the member 54 is initially selected so that its opposite surface 58 projects into the rotative path 30 of the vanes 12. As a result, the edges 46 of the vanes are effective in removing by contact with the surface 58 of member 54 select portions thereof, which results in an optimum minimum running clearance being established between the vane edges 46 and the surface 58 of the foam plastic member 54. This results in providing an effective upper seal between the inlet 32 and the outlet 34 of the pumping chamber 26.

Figure 7:
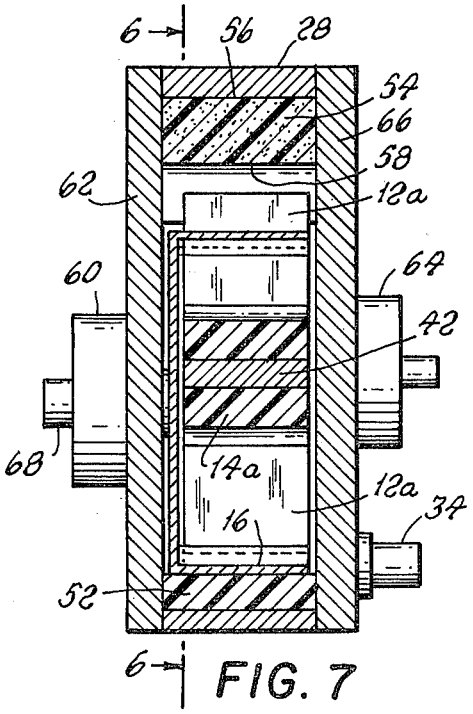

For completeness sake, and as is best illustrated in FIG. 7, it should be noted that the rotor 16 has a bearing 60 which journals the rotor 16 for rotation in an end plate 62, and that the impeller 10*a* similarly has a bearing 64 so that this component also can be journaled for rotation in an opposite end plate 66, said end plates 62 and 66 being appropriately connected by bolts or the like to the cylindrical housing component 28. The motor or prime mover (not shown) for driving the rotor 16 in rotation is connected via an appropriate driving connection to the rotor drive shaft 68.

A latitude of modification, change and substitution is intended in the foregoing disclosure and, in some instances, some features of the invention will be employed without a corresponding use of other features. Accordingly, it is appropriate that the appended claims be construed broadly and in a manner consistent with the spirit and scope of the invention herein.

What is claimed is:

1. In an impeller for a centrifugal pump of the type having an operative position rotatably mounted in a pumping chamber in said pump and consisting of an elastomeric hub and plural vanes circumferentially spaced to extend in radial relation from said hub, the improvements to said impeller comprising each vane being of a geometric shape and operatively disposed with a first outer edge thereof moving through a rotative path about the periphery of said pumping chamber and said opposite second inner edge thereof molded in situ in said elastomeric hub with the area of said vane extending between said first and second edges adapted to exert pressure against fluid being pumped during pumping service of said pump, and for each said vane a compartment formed in said hub by the absence of elastomeric material in an area coincident with and extending along the length of said second edge so as to permit unimpeded movement of said second edge in said compartment, whereby in response to changing angular orientations of the vanes in said elastomeric hub the said resulting movement in said second edge by being unimpeded is with minimum stretching and compression in said surrounding elastomeric material of said hub and correspondingly contributes to obviating any rupture in said hub.

2. The improvements for a centrifugal pump impeller as claimed in claim 1, wherein each said compartment is cylindrically shaped and a cooperating vane second inner edge projects in radial relation into said compartment.

3. The improvements for a centrifugal pump impeller as claimed in claim 1, including a foam plastic member operatively disposed in the periphery of said pumping chamber in slight projected relation into the path of movement of said first outer edges of said vanes, whereby there is removal by contact by said vanes of material from said foam plastic member so as to provide an optimum minimum running clearance between said vanes and said foam plastic member.

* * * * *